United States Patent [19]

Geller

[11] 4,013,930

[45] Mar. 22, 1977

[54] ELECTRONIC DOOR LOCK

[75] Inventor: David Geller, Chicago, Ill.

[73] Assignee: Wico Corporation, Niles, Ill.

[22] Filed: Oct. 20, 1975

[21] Appl. No.: 624,055

[52] U.S. Cl. ..... 361/172; 70/278

[51] Int. Cl.[2] ..... E05B 47/02

[58] Field of Search ..... 317/134; 70/278, 279, 70/280

[56] References Cited

UNITED STATES PATENTS

| | | | |
|---|---|---|---|
| 3,831,065 | 8/1974 | Martin | 317/134 |
| 3,877,266 | 4/1975 | McLaughlin | 70/280 |

*Primary Examiner*—R. N. Envall, Jr.
*Attorney, Agent, or Firm*—Fitch, Even, Tabin & Luedeka

[57] ABSTRACT

An electronic door lock has a lockbolt operable between locked and unlocked positions by an electrically energizable bolt mover which is responsive to an electronic locking circuit and an electronic unlocking circuit. A switch actuates the electronic unlocking when the door is to be opened. A control circuit, also responsive to the switch, generates a control signal which is time-delayed by at least a predetermined interval after the actuation of the unlocking circuit. The locking circuit responds to the control signal by energizing the bolt mover so as to move the lockbolt to the locked position, thereby causing the door to be automatically locked after at least the predetermined interval following the unlocking of the door.

10 Claims, 1 Drawing Figure

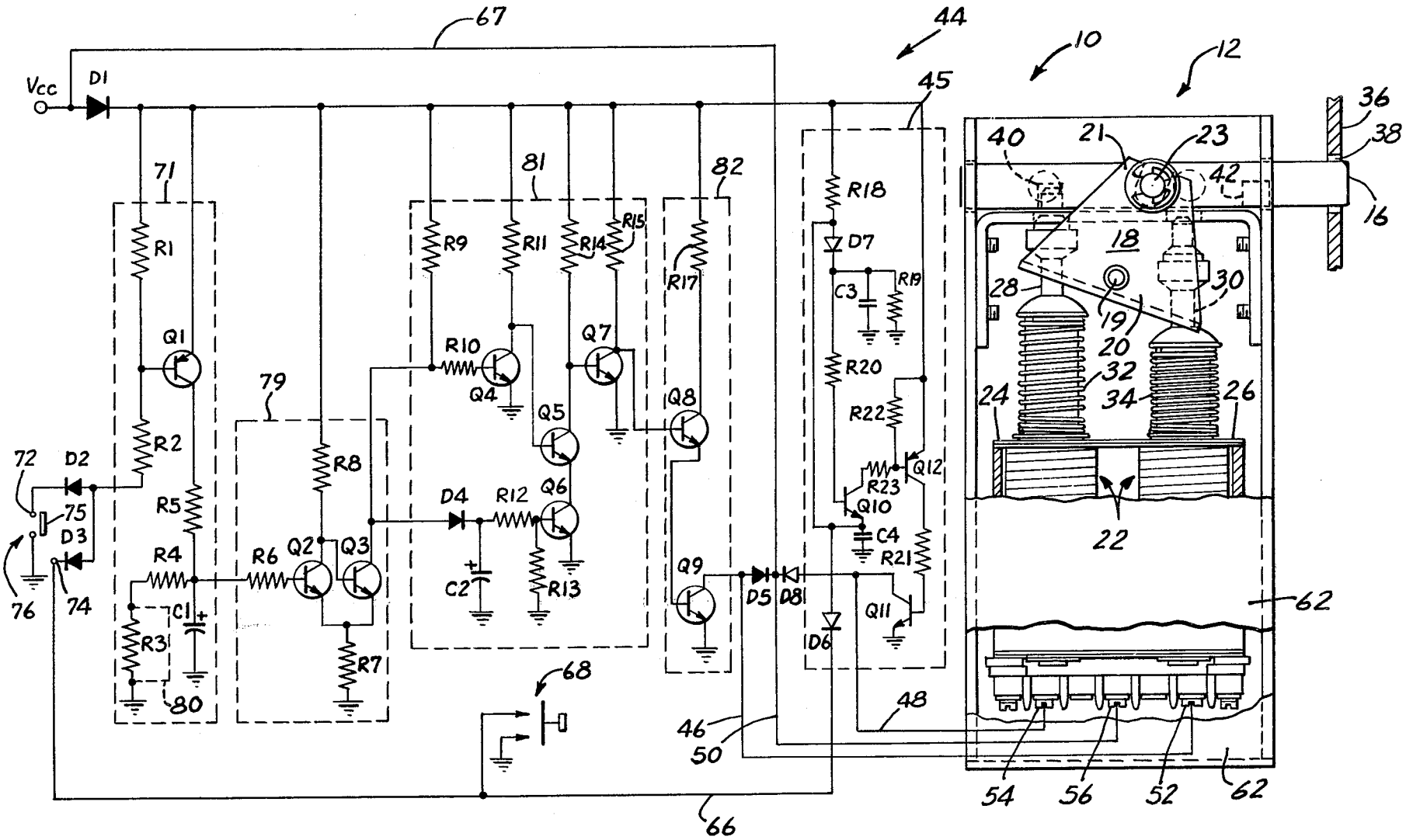
36
38
16
62
12
23
42
30
26
18
19
20
32
34
22
21
10
40
28
24
52
56
54
44
45
R18
D7
R19
C3
R20
R22
Q12
R23
Q10
C4
R21
Q11
48
D6
D8
D5
82
R17
Q8
Q9
46
50
66
R15
R14
Q7
Q5
Q6
R13
68
81
R11
R12
Q4
R10
D4
C2
R9
67
R8
Q3
R7
Q2
79
R6
71
R1
Q1
R2
R5
R4
C1
R3
80
D1
Vcc
D2
75
D3
74
72
76

ELECTRONIC DOOR LOCK

The present invention generally relates to locking devices and, more specifically, to electrically actuated door locks having a self-locking feature. The illustrated door lock is particularly adapted for preventing the door of a delivery truck or the like from being left unlocked.

Electrically actuated door locks controlled from a remote location are well known and commonly employ solenoids as lockbolt actuating means for selectively driving the lockbolt between locked and unlocked positions. Typically, the lock is unlocked by actuation of a remote switch which energizes a solenoid which moves the lockbolt to an unlocked position relative to a keeper plate, or the like, mounted on either the door or the door jam. Access may then be gained into the region secured by the locked door. A switch may also be actuated when the door is closed to energize a locking solenoid to return the lock to the locked position. After the door is closed, however, the lock may inadvertently be left in the unlocked position because the locking switch has not been actuated, subjecting the region normally secured by the locked door to pilferage.

Remotely operated door locks find particular application in trucks having an enclosed storage compartment and used for delivering merchandise to retail or wholesale outlets, for example. In trucks of this type the remote switch which energizes the unlocking solenoid may be mounted in the cab and actuated by the driver before leaving the cab to remove merchandise from the freight area. Experience has shown that after the goods are removed from the truck, the driver may close the door but inadvertently leave it unlocked, exposing the goods remaining in the truck to sneak thieves while the goods are hand delivered into a merchant's store.

Various types of locks have been devised to assure protection against exposing a frequently accessed area to pilferage resulting from inadvertently leaving a security door unlocked, however, these prior art devices suffer various disadvantages.

Accordingly, it is a primary object of the present invention to provide an improved electronic door lock for use on doors, or the like, having a self-locking feature for placing the lock in a locked position a preselected time after closure of the door.

It is another object of the invention to provide an improved electronic door lock having a control circuit which de-energizes a lockbolt actuating means after the lockbolt is moved to the locked position.

Other objects and advantages will become apparent upon reading the following detailed description, with reference to the attached drawing, which is a schematic diagram of an electronic control circuit connected to a door lock shown in elevation, with certain portions cut away, illustrating various features of an embodiment of the present invention.

In accordance with the illustrated embodiment of the invention, electrical control apparatus is provided for locking doors and the like and includes a lockbolt operable between locked and unlocked positions by an electrically energizeable bolt mover selectively energized by electronic locking and unlocking circuits. Switching means actuates the electronic unlocking circuit when the door is to be unlocked. Control means, responsive to the switching means, generates a control signal which is time-delayed by at least a predetermined interval after the actuation of the unlocking circuit. The locking circuit responds to the control signal by energizing the bolt mover so as to move the lockbolt to the locked position, thereby causing the door to be automatically locked after at least said predetermined interval following the unlocking of the door.

The electronic control apparatus herein described is shown in conjunction with an electrical solenoid deadbolt lock of the type described in U.S. Pat. No. 3,897,093 issued July 29, 1975, and assigned to the assignee hereof. The disclosure of U.S. Pat. No. 3,897,093 is hereby incorporated herein by reference thereto. Referring to the drawing, an electronic door lock generally indicated at 10 includes a door lock assembly 12 which comprises a frame or housing 14 in which a lockbolt 16 is mounted for reciprocal movement along a predetermined path. A cradle 18 has a lower portion 20 pivotably mounted on the frame 14 at pivot pin 19 and an upper portion 21 rotatably coupled to the lockbolt 16 at pivot pin 23. Lockbolt actuating means 22 comprising solenoids 24 and 26, in the illustrated embodiment, are positioned on opposite sides of the cradle 18 and actuate plungers 28 and 30 biased by springs 32 and 34, respectively, toward an extended or upward position. In general, actuation of one of the solenoids causes the cradle 18 to pivot and move lockbolt 16 toward the side occupied by the actuated solenoid. When the lockbolt reaches the end of this path, the normally outwardly biased plunger of the nonactuated solenoid engages an aperture in the lockbolt 16 to restrain the lockbolt from leaving its position. Release of the lockbolt requires actuation of the restraining solenoid which pulls the plunger from the aperture, and engages the cradle to move the lockbolt in the opposite direction. The door lock frame 14 is adapted for being secured to a structure to be locked and a cooperating keeper plate 36 is secured to the facing structure. The keeper plate 36 is secured to the stationary or movable structure, and the door lock 12 is mounted in the door or jam (not shown) with the lockbolt 16 aligned with an opening 38 in the keeper plate 36, as shown. In the illustrated embodiment, the solenoid 24 is the unlocking solenoid, and the solenoid 26 is the locking solenoid. When the locking solenoid 26 is energized, the plunger 30 causes the cradle 18 to pivot in a clockwise direction as seen in the FIGURE, moving the lockbolt 16 into the opening 38 in the keeper plate 36. The spring biased plunger 28 of the unlocking solenoid 24 then enters an aperture 40 in the lockbolt 16 retaining the lockbolt in the locked position. When the unlocking solenoid 24 is energized, the plunger 28 pivots the cradle 18 in the counterclockwise direction, moving the lockbolt 16 away from the keeper plate 36. When the end of this path of the lockbolt is reached, the end of the spring biased locking plunger 30 engages an aperture 42 in the lockbolt 16 retaining the lockbolt in the unlocked position. A more detailed description of the depicted door lock assembly 12 will be found in the aforementioned U.S. Pat. No. 3,897,093.

Electrical control apparatus 44 actuates the solenoids 24 and 26 by means of electrical signals transmitted along conductors 46, 48, and 50 which lead from the control circuit to terminal 52 of the locking solenoid 26, terminal 54 of the unlocking solenoid 24 and terminal 56 which is common to both solenoids, respectively. In the preferred embodiment, electrical control apparatus 44 is positioned on a circuit board (not shown) mounted on the inside of a cover 62 which is removably secured onto the frame or housing 14, so that the entire device forms a self-contained unit. To this end, the width of the side frame members 58 and 60 are proportioned so that electrical control apparatus 44 is spaced apart from the moving components of the lock 12. A relatively small aperture (not shown) may be provided in the cover or housing to permit passage of electrical conductors leading from a power supply, such as a truck battery, for example, if the device is used on a vehicle. The conductors 46, 48 and 50 may also extend through this aperture if the control apparatus is mounted at a remote location to the lock 12.

Electrical control apparatus 44 is biased by a bias voltage source Vcc which may be supplied from the truck battery. Control apparatus 44 controls the locking and unlocking of lockbolt 16 and includes an unlocking circuit 45, a locking circuit 82, and control means which includes circuit blocks 71, 79, and 81. Unlocking circuit 45 actuates solenoid 24 for moving lockbolt 16 to the unlocked position. The control means (blocks 71, 79, and 81) generate a control signal which is time-delayed by at least a predetermined interval after the actuation of the unlocking circuit 45. Locking circuit 82 receives the control signal and energizes locking solenoid 26, thereby causing the door to be automatically locked after at least a predetermined interval following the unlocking of the door. More specifically, if the door remains closed for a predetermined interval after having been unlocked, it will be automatically locked after that predetermined interval. If, however, the door is opened after having been unlocked, it will remain unlocked as long as it stands open. When the opened door is subsequently closed, the door will be automatically locked after having been closed for the predetermined interval. This mode of operation of the illustrated embodiment, as well as other features of this embodiment, will become apparent following the detailed description below.

Unlocking circuit 45 includes transistors Q10, Q11 and Q12, all of which are normally off. Q11 is the output transistor for this circuit and provides a path to ground for the supply voltage Vcc through unlocking solenoid 24, terminal 54, conductor 48 and transistor Q11. Q12 is a driving transistor for Q11. Transistor Q10 and a timing network consisting of capacitor C3 and its associated resistance automatically turn transistors Q11 and Q12 off after a predetermined interval, in a manner to be described below, to avoid damaging solenoid 24 by energization thereof for a prolonged period.

The base of transistor Q11 is coupled in series with the collector of transistor Q12 and is therefore off whenever transistor Q12 is off. Normally, transistor Q12 is held off by the bias voltage applied to it through resistor R22. In order for Q12 to conduct, transistor Q10 must conduct and lower the voltage at the base of transistor Q12.

The emitter of transistor Q10 is coupled in series with diode D6, conductor 66 and switch 68. Thus, whenever switch 68 is not actuated, the emitter circuit of transistor Q10 is open and Q10 cannot conduct. The base of transistor Q10 is coupled through resistor R20 to capacitor C3 and resistor R19. Normally, capacitor C3 accumulates a charge of several volts through diode D7 and resistor R18. The voltage present across capacitor C3 is also present at the base of transistor C10, but it cannot forward-bias the base emitter junction of transistor Q10 so long as switch 68 remains unactuated and the emitter circuit of transistor Q10 remains open. Capacitor C4 is included to bypass unwanted AC signals to ground which might otherwise be coupled to the emitter for transistor Q10 and to prevent Q10 from oscillating.

Unlocking circuit 45 is energized by the actuation of momentary switch 68, as shown, which grounds conductor 66 and completes the emitter circuit of transistor Q10. The actuation of switch 68 also serves to complete a path to ground from Vcc through R18, diode D6, conductor 66 and switch 68. As a result, current flows through resistor R18, and the subsequent voltage drop at the anode side of diode D7 reverse biases diode D7. With diode D7 off, capacitor C3 no longer charges, but must discharge through resistor R19, R20 and transistor Q10. With its emitter circuit now complete through switch 68 and with capacitor C3 discharging through its base, transistor Q10 now conducts. The collector current of transistor Q10 flows through resistors R22 and R23, thereby resulting in a voltage drop at the base of transistor Q12 which turns transistor Q12 on. The collector current of transistor Q12 is injected into the base of transistor Q11 which also turns on and energizes unlocking solenoid 24. Thus energized, solenoid 24 draws plunger 28 downwardly and causes cradle 18 to pivot about pin 19 so as to draw lockbolt 16 to the unlocked position.

When switch 68 opens, transistor Q10 turns off and thereby turns off transistors Q11 and Q12 and de-energizes unlocking solenoid 24. However, should switch 68 remain inadvertently actuated, transistor Q10 will automatically turn off after a predetermined interval due to the inability of capacitor C3 to indefinitely retain its charge while diode D7 is reverse biased. Assuming that switch 68 does remain actuated, capacitor C3 continues to discharge through resistors R19, R20, and transistor Q10. Ultimately, after an interval determined by the time constant associated with capacitor C3 and its associated resistance, the voltage across C3 will decrease to a point where it is no longer able to sustain conduction of transistor Q10. At that time, transistors Q10, Q11 and Q12 will turn off, as will unlocking solenoid 24. This automatic de-energization of locking solenoid 24 by the timing network, which includes capacitor C3 and its associated resistance, is a safety feature which ensures that unlocking solenoid 24 will be automatically de-energized when switch 68 is actuated for longer than the predetermined interval. Therefore, solenoid 26 cannot be inadvertently damaged by prolonged actuation of switch 68.

After the door has been unlocked by unlocking circuit 45, it may be opened, whereupon switch 76, responsive to the opening and closing of the door, is actuated. Switch 76 is preferably a reed switch located within the magnetic field of a magnet 78 mounted in the door. When the door is closed, magnet 78 holds switch 76 open. When the door is opened, switch 76 is no longer under the influence of magnet 78 and reverts to the closed position, thereby grounding terminal 72. Thus, opening the door causes switch 76 to change its state and to thereby activate the control circuit which includes circuit blocks 71, 79 and 81 and locking circuit 82, each of which will now be briefly described.

Block 71 is a timing circuit which, as will be described below, determines when lockbolt 16 will be automatically returned to the locking position when the door is closed.

Block 79 is a Schmitt trigger circuit whose output voltage is determined by the condition of timing circuit 71.

Block 81 contains an AND gate whose output voltage is determined both by the output of Schmitt trigger circuit 79 and the condition of a second timing circuit comprising capacitor C2 and resistors R12 and R13. This second timing circuit determines the duration of the locking current which will be automatically applied to locking solenoid 26.

Finally, block 82 is a locking circuit which delivers the locking current to locking solenoid 26.

In order to more clearly describe the changes which take place upon the opening of the door and the resulting actuation of switch 76, the quiescent condition (that is, the condition which exists when the door is closed and locked) of each of the transistors will be first described.

Normally, with the door closed, switch 76 is open and Q1 is biased off by supply voltage Vcc which is applied to the base of transistor Q1 through resistor R1. Capacitor C1 which forms part of a timing circuit will have discharged through resistors R3 and R4 and will have caused the voltage at the base of transistor Q2 to drop to a level at which Q2 turns off.

Since transistor pair Q2-Q3 forms bi-stable Schmitt trigger, transistor Q3 is on whenever transistor Q2 is off, and vice versa (neglecting the switching times when both Q2 and Q3 are changing states).

With Q2 off and Q3 on, the voltage drop across resistor R9 due to the collector current of transistor Q3 biases transistor Q4 off. Likewise, with transistor Q3 conducting, capcitor C2 is unable to accumulate charge through diode D4 and discharges through resistors R12 and R13 and the input resistance of transistor Q6. To ensure that current cannot pass through diode D4 to charge capacitor C2 while transistor Q3 is on, the resistive value of R7 is small compared to the resistive value of R12.

Assuming that C2 has been able to discharge completely, transistor Q6 is off and transistor Q5 is prevented from conducting, thereby permitting the voltage at the collector of transistor Q5 to be large enough to bias transistor Q7 on.

With transistor Q7 on, the voltage drop across resistor R15 is large enough to ensure that transistors Q8 and Q9 coupled together in a Darlington configuration, are all off. Since transistor Q9 is connected in series with the coil (not shown) of locking solenoid 26, locking solenoid 26 cannot now be energized.

Having explained the quiescent state of the various elements, assume now that switch 68 is actuated to unlock the door and that the door is then opened. With the door open and terminal 72 now grounded through switch 76, (and ignoring, for the moment, the effect of switch 68 on timing circuit 71), a current flows from Vcc through diode D1, resistor R1, resistor R2, diode D2 and to ground through switch 76. The resulting voltage drop across resistor R1 causes transistor Q1 to conduct and to charge capacitor C1. When the voltage across capacitor C1 reaches a predetermined level, transistor Q2 turns on and transistor Q3 turns off. With transistor Q3 off, capacitor C2 now charges through diode D4 and establishes a voltage at the base of transistor Q6 which turns transistor Q6 on.

With Q3 off, the higher voltage now present at the base of transistor Q4 turns transistor Q4 on. The resulting collector current of transistor Q4 creates a sufficiently large voltage drop across resistor R11 to turn transistor Q5 off. With transistor Q5 off, transistor Q6 is prevented from conducting and transistor Q7 remains on. As a result of the voltage drop across resistor R15 due to the collector current of transistor Q7, transistors Q8 and Q9 remain off and no current is delivered to locking solenoid 26.

Although the opening of the door caused no change in the condition of locking circuit 82, (that is, transistor Q11 was off with the door closed and remains off with the door open), capacitors C1 and C2 have accumulated charged which will be used to regulate the locking of the door when the door is closed. Thus, the opening of the door and the resultant closing of switch 76 has "set" the timing circuitry for the next sequence of events.

Assuming now that capacitors C1 and C2 have become fully charged, and assuming that the door has now been closed, the following sequence of events occurs. First, the closing of the door places switch 76 once again under the influence of magnet 78 which causes switch 76 to open. With switch 76 open, terminal 72 becomes ungrounded and the voltage on the base of transistor Q1 rises toward the supply voltage Vcc and turns transistor Q1 off. Capacitor C1 must now discharge through resistors R3 and R4, this causing the voltage at the base of transistor Q2 to drop. Once capacitor C1 has discharged for an interval determined by the time constant of the R3, R4, C1 network, transistor Q2 turns off and transistor Q3 turns on.

With transistor Q3 on, transistor Q4 is turned off and transistor Q5 is turned on. Also, with transistor Q3 now conducting, capacitor C2 can no longer charge through diode D4 but must discharge through resistors R12 and R13 and transistor Q6. Transistor Q6 thus remains biased on by the charge on C2, at least temporarily, and permits Q5 to conduct and lower the voltage at the base of Q7. Transistor Q7 then turns off and transistors Q8 and Q9 turn on and actuate locking solenoid 26.

The current passing through the coil of locking solenoid 26 will continue as long as transistor Q5 and Q6 are both on. However, capacitor C2 eventually discharges to the point where it can no longer support the conduction of transistor Q6. This causes transistors Q6 and Q5 to turn off and transistor Q7 to turn on. Transistors Q8 and Q9 are also turned off, thereby discontinuing the energization of locking solenoid 26.

To briefly summarize the operation of control circuit 44 as described in detail above, assume that the door is initially closed and locked. When the operator wishes to unlock the door, he closes momentary switch 68 which activates unlocking circuit 45 and unlocking solenoid 24. When the door is opened, switch 76 closes and causes capacitors C1 and C2 to accumulate charge, thereby "setting" the respective timing circuits (Q8 and Q9 remain off and lockbolt 16 remains in the unlocked position). This condition continues as long as the door remains open. When the door is subsequently closed, switch 76 opens and causes capacitor C1 to discharge, thereby actuating output transistors Q8 and Q9 and causing locking solenoid 26 to drive lockbolt 16 to the locked position.

Soon thereafter (no more than 5 seconds, preferably) capacitor C2 discharges to the point where it can no longer sustain conduction in transistor Q2 and transistors Q8 and Q9 are turned off, thereby de-energizing locking solenoid 26.

Although no interaction between switch 68 and timing circuit 71 has as yet been mentioned, it is evident from the drawing that switch 68 does cause the timing circuits associated with capacitors C1 and C2 to be set in a manner similar to that in which switch 76 operates. For example, should no operator close switch 68 with the intention of unlocking and opening the door, but then fail to open the door after the unlocking has taken place, he will have caused the timing circuits to become reset by grounding resistor R2 through diode D3 and switch 68. To ensure that capacitor C1 becomes fully charged, the value of C1 and its associated resistances are chosen such that C1 charges and turns Q2 on before the ground is removed from resistor R2. Switch 68 is preferably a momentary contact switch which remains closed for a short time even after being released so that capacitor C1 becomes fully charged each time switch 68 is closed. Thus, even if the door remains closed after being unlocked, the timing circuits will have been reset. Then, when switch 68 is released, C1 begins to discharge and, in a few seconds (depending on the designer's choice of the time constant for C1) Q2 will turn off and locking solenoid 26 will be energized. The timing circuit associated with C2 will then cause the locking solenoid to be de-energized within a few seconds. Accordingly, the door will have been re-locked even without the actuation of switch 76.

Diodes D2 and D3 are included as shown to isolate the functions of switches 76 and 68, respectively. For example, switches 68 and 76 can both ground resistor R2, but, because of diodes D2 and D3, switch 76 cannot unlock lockbolt 16.

Diodes D1, D5 and D8 are included to protect control apparatus 44, and particularly transistors Q9 and Q11, from transient voltages developed by the collapse of the magnetic fields associated with solenoids 24 and 26.

As shown in the drawing, a jumper 80 can be placed in parallel with resistor R3 to vary the time constant associated with capacitor C1. This permits the timing circuit to be easily adjusted to fit the requirements of a particular application.

When the illustrated lock control apparatus is used to control the locking of a truck door, safety precautions may require that the door which is being controlled not be automatically locked when the truck is in motion. The locking circuitry can, in that case, be disabled whenever the truck is in motion by connecting a resistor between the ignition switch and the junction of capacitor C1 and resistor R4 so as to couple C1 to the battery voltage when the ignition switch is ON. This will maintain a charge on C1 while the truck is in motion and prevent the door from automatically locking.

In a specific device constructed in accordance with the illustrated embodiment, components were used having the values as follows: R1 = 2,200 ohms, R2 = 2,200 ohms, R3 = 22,000 ohms, R4 = 10,000 ohms, R5 = 10,000 ohms, R6 = 56,000 ohms, R7 = 220 ohms, R8 = 39,000 ohms, R9 = 6,800 ohms, R10 = 4,700 ohms, R11 = 5,600 ohms, R12 = 6,800 ohms, R13 = 3,300 ohms, R14 = 10,000 ohms, R15 = 1,000 ohms, R17 = 33 ohms, R18 = 3,300 ohms, R19 = 22,000 ohms, R20 = 4,700 ohms, R21 = 33 ohms, R22 = 22,000 ohms, R23 = 2,200 ohms, C1 = 100 microfarads, C2 = 100 microfarads, C3 = 5 microfarads, and C4 = 0.01 microfarads. In this device, the bias voltage source Vcc was set at 12 volts and is therefore adaptable to the battery conventionally used in automobile and truck ignition system. This invention, is of course, contemplated as being useful in applications other than automobiles or trucks.

In light of the above description of the illustrated embodiment, it is apparent that there has been provided, in accordance with the objectives of this invention, an improved electronic door lock capable of automatically locking a door and de-energizing the locking mechanism after the locking is effected. In addition, the described door lock re-locks itself after a preselected time in the case where the door becomes unlocked but remains closed.

Although this invention has been described in terms of the illustrated preferred embodiment, many variations and modifications therein will be apparent to those skilled in the art. Accordingly, this invention is intended to cover all such variations and modifications which fall within the spirit and scope of the appended claims.

What is claimed is:

1. Electrical control apparatus for use in locking and unlocking a closed door which has a lockbolt capable of being moved between a locked position and an unlocked position by an electrically energizeable bolt mover, comprising:

an electronic unlocking circuit for energizing the bolt mover so as to move the bolt to the unlocked position;

switching means for actuating said electronic unlocking circuit when the door is to be unlocked;

control means responsive to said switching means for generating a control signal time-delayed by at least a predetermined interval after the actuation of said unlocking circuit; and an electronic locking circuit responsive to said time-delayed control signal for energizing the bolt mover only when the door is closed so as to move the lockbolt to the locked position, thereby causing said door, when closed, to be automatically locked after at least said predetermined interval following the unlocking of the door.

2. Electrical control apparatus as set forth in claim 1 wherein said control means includes timing means responsive to the actuation of said unlocking circuit for causing the control signal to be generated when a door which has been unlocked remains unopened for the predetermined interval.

3. Electrical control apparatus as set forth in claim 1 wherein said electronic unlocking circuit includes timing means for automatically de-energizing the bolt mover when said switching means is actuated for longer than a predetermined interval, thereby ensuring that the bolt mover cannot be inadvertently damaged by prolonged actuation of said switching means.

4. Electrical control apparatus for use in locking and unlocking a door which has a lockbolt capable of being moved between a locked position and an unlocked position by an electrically energizeable bolt mover, comprising:

an electronic unlocking circuit for energizing the bolt mover so as to move the bolt to the unlocked position;

switching means for actuating said electronic unlocking circuit when the door is to be unlocked;

control means responsive to said switching means for generating a control signal time-delayed by at least a predetermined interval after the actuation of said unlocking circuit;

an electronic locking circuit responsive to said time-delayed control signal for energizing the bolt mover so as to move the lockbolt to the locked position, thereby causing said door to be automatically locked after at least said predetermined interval following the unlocking of the door; and second switching means responsive to the opening and closing of a door for causing said control means to delay the generation of the control signal until a door which has been unlocked and opened is subsequently closed.

5. Electronic control apparatus as set forth in claim 4 wherein said control means includes second timing means coupled to said locking circuit for turning off said locking circuit and thereby de-energizing the bolt mover at a predetermined interval after the door is locked.

6. Electrical control apparatus for use in locking and unlocking a door which has a lockbolt capable of being moved between a locked position and an unlocked position by an electrically energizeable bolt mover, comprising:

an electronic unlocking circuit for energizing the bolt mover so as to move the lockbolt to the unlocked position;

first switching means for actuating said electronic unlocking circuit when the door is to be unlocked;

means including a first timing circuit responsive to said first switching means for generating a control signal which is time-delayed from the actuation of said unlocking circuit by a predetermined interval when the unlocked door remains closed for at least said predetermined interval;

second switching means responsive to the opening and closing of the door for causing said control means to delay generating the control signal until said predetermined interval after a door which has been unlocked and opened is subsequently closed;

an electronic locking circuit coupled to the output of said control means for energizing the bolt mover so as to move the lockbolt to the locked position when a control signal is received; and a second timing circuit responsive to said first timing circuit and coupled to said locking circuit for turning off said locking circuit and thereby de-energizng the bolt mover at another predetermined interval after the door is locked.

7. Electrical control apparatus for use in locking and unlocking a door which has a lockbolt capable of being moved between a locked position and an unlocked position by an electrically energizeable bolt mover, comprising:

a manually operable switch for unlocking the door;

an electronic unlocking circuit responsive to the actuation of said manually operable switch for energizing the bolt mover so as to move the lockbolt to the unlocked position;

a first resistance-capacitance timing network coupled to said manually operable switch and having a first timing capacitor which charges when the manually operable switch is actuated;

a second switch responsive to the opening and closing of the door and coupled to said first timing network so as to maintain the charge on the first timing capacitor while the door is open and for causing the timing capacitor to discharge when the door is subsequently closed;

a bi-stable electronic circuit which is responsive to the amount of charge on said first timing capacitor and which has a first output signal when said first timing capacitor becomes charged above a predetermined level and a second output signal when said timing capacitor is discharged below a predetermined level;

a second resistance-capacitance timing network coupled to said bi-stable electronic circuit and having a second timing capacitor which becomes substantially charged when said bi-stable electronic circuit generates said first output signal and which discharges at a predetermined rate when said bi-stable electronic circuit generates said second output signal;

an AND gate coupled to said second timing network and to said bi-stable electronic circuit, said AND gate generating a locking signal only when said second timing capacitor is charged above a predetermined level and when said bi-stable electronic circuit generates said second output signal; and an electronic locking circuit coupled to the bolt mover and receiving the output of said AND gate for energizing the bolt mover so as to move the lockbolt to the locked position only when the AND gate generates the locking signal, thereby causing the door to become unlocked when said manually operable switch is actuated, causing the door to remain unlocked after have been opened, causing the door to automatically lock after being closed, and causing the bolt mover to be de-energized after the door becomes locked.

8. Electrical control apparatus as set forth in claim 7 wherein said electronic unlocking circuit includes a resistance-capacitance timing network for automatically de-energizing the bolt mover when said manually operable switch is actuated for longer than a predetermined interval, thereby ensuring that the bolt mover cannot be inadvertently damaged by prolonged actuation of said manually operable switch.

9. Electrical control apparatus for use in locking and unlocking a door having a lockbolt which is movable between a locked position and an unlocked position by means of a locking solenoid and an unlocking solenoid, each of which drives a movable plunger which is mechanically coupled to the lockbolt, comprising:

an electronic unlocking circuit for energizing the unlocking solenoid so as to move the lockbolt to the unlocked position;

a manually operable momentary switch for actuating said electronic unlocking circuit when the door is to be unlocked;

circuit means including a first resistance-capacitance timing network responsive to said manually operable switch for generating a control signal when the unlocked door remains closed for a predetermined interval;

a second switch responsive to the opening and closing of the door for causing said circuit means to delay generating the control signal until said predetermined interval after a door which has been unlocked and opened is subsequently closed;

an electronic locking circuit coupled to the output of said circuit means for energizing the locking solenoid so as to move the lockbolt to the locked position when a control signal is received;

a second resistance-capacitance timing network responsive to said first timing network and coupled to said locking circuit for turning off said locking circuit and thereby de-energizing the locking solenoid at another predetermined interval after the door is locked.

10. Electrical control apparatus as set forth in claim 9 wherein said electronic unlocking circuit includes a resistance-capacitance timing network for automatically de-energizing the bolt mover when said momentary switch is actuated for longer than a predetermined interval, thereby ensuring that the bolt mover cannot be inadvertently damaged by prolonged actuation of said momentary switch.

* * * * *

UNITED STATES PATENT AND TRADEMARK OFFICE

CERTIFICATE OF CORRECTION

PATENT NO. : 4,013,930

DATED : March 22, 1977

INVENTOR(S) : David Geller

It is certified that error appears in the above-identified patent and that said Letters Patent are hereby corrected as shown below:

Column 4, line 6, "emitter for" should be --emitter of--.
Column 5, line 28, before "bi-stable" insert --a--.
Column 5, line 35, "capcitor" should be --capacitor--.
Column 6, line 15, "charged" should be --charges--.
Column 7, line 8, "should no" should be --should an--.
Column 8, line 3, "system" should be --systems--.
Column 9, lines 48 and 49, "de-energizng" should be --de-energizing--.
Column 10, line 31, "have" should be --having--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*